US008096751B2

(12) United States Patent
Arrell et al.

(10) Patent No.: US 8,096,751 B2
(45) Date of Patent: Jan. 17, 2012

(54) TURBINE ENGINE COMPONENT WITH COOLING PASSAGES

(75) Inventors: Douglas J. Arrell, Oviedo, FL (US); Allister W. James, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 827 days.

(21) Appl. No.: 12/183,168

(22) Filed: Jul. 31, 2008

(65) Prior Publication Data

US 2010/0028131 A1 Feb. 4, 2010

(51) Int. Cl.
*F01D 5/14* (2006.01)

(52) U.S. Cl. ..... 415/115; 415/116; 416/95; 416/96 A

(58) Field of Classification Search ..... 415/115, 415/116, 173.1, 138, 139, 200; 416/95, 96 R, 416/96 A, 97 R, 241 R, 241 B
See application file for complete search history.

(56) References Cited

U.S. PATENT DOCUMENTS

| | | | | |
|---|---|---|---|---|
| 3,613,207 | A * | 10/1971 | Malburg | 29/890.01 |
| 3,616,125 | A | 10/1971 | Bowling | |
| 4,055,705 | A | 10/1977 | Stecura et al. | |
| 5,328,331 | A | 7/1994 | Bunker et al. | |
| 5,640,767 | A | 6/1997 | Jackson et al. | |
| 5,820,337 | A | 10/1998 | Jackson et al. | |
| 6,000,908 | A | 12/1999 | Bunker | |
| 6,347,660 | B1 | 2/2002 | Sikkenga et al. | |
| 6,607,355 | B2 | 8/2003 | Cunha et al. | |
| 7,874,804 | B1 * | 1/2011 | Brown | 416/193 A |
| 2003/0143065 | A1 * | 7/2003 | Takahashi et al. | 415/115 |

* cited by examiner

*Primary Examiner* — Ajay K Arora

(57) ABSTRACT

A component for use in a turbine engine including a first member and a second member associated with the first member. The second member includes a plurality of connecting elements extending therefrom. The connecting elements include securing portions at ends thereof that are received in corresponding cavities formed in the first member to attach the second member to the first member. The connecting elements are constructed to space apart a first surface of the second member from a first surface of the first member such that at least one cooling passage is formed between adjacent connecting elements and the first surface of the second member and the first surface of the first member.

20 Claims, 2 Drawing Sheets

TURBINE ENGINE COMPONENT WITH COOLING PASSAGES

This invention was made with U.S. Government support under Contract Number DE-FC26-05NT42644 awarded by the U.S. Department of Energy. The U.S. Government has certain rights to this invention.

This application is related to U.S. patent application Ser. No. 12/183,185, filed concurrently herewith, entitled "INJECTION MOLDED COMPONENT", the entire disclosure of which is incorporated by reference herein.

FIELD OF THE INVENTION

The present invention generally relates to components for use in a gas turbine engine, and more particularly, to components including a first member and a second member including connecting elements that facilitate a spaced apart attachment of the second member to the first member.

BACKGROUND OF THE INVENTION

U.S. Pat. No. 5,328,331 discloses an airfoil for use in a gas turbine engine comprising integrally formed inner and outer walls, with the inner wall surrounding an inner cavity. Airfoils of this type have been developed to increase engine efficiency by maximizing cooling. However, spacing between the outer and inner walls and the common material forming the integral outer and inner walls may reduce cooling.

SUMMARY OF THE INVENTION

In accordance with one aspect of the present invention, a component for use in a turbine engine comprises a first member and a second member associated with the first member. The second member includes a plurality of connecting elements extending therefrom. The connecting elements include securing portions at ends thereof that are received in corresponding cavities formed in the first member to attach the second member to the first member. The connecting elements are constructed to space apart a first surface of the second member from a first surface of the first member such that at least one cooling passage is formed between adjacent connecting elements and the first surface of the second member and the first surface of the first member.

The first member may be formed from a first material and the second member may be formed from a second material different from the first material.

The first material may have a coefficient of thermal expansion which is greater than a coefficient of thermal expansion of the second material.

The first material may be a nickel-based superalloy or a cobalt-based superalloy and the second material may comprise an aluminide or a material comprising Cr, Al, and at least one of Fe, Co, and Ni.

The securing portion of at least one of the connecting elements may be tail shaped and at least one of the cavities may define a socket to receive the tail-shaped securing portion.

The connecting element may comprise an intermediate portion integral with the tail-shaped securing portion. The intermediate portion may have first and second parts. The first part may have a width dimension greater than a width dimension of the second part such that a step is formed where the first and second parts meet. The step may engage the first surface of the first member when the tail-shaped securing portion is positioned in the socket.

The tail-shaped securing portion may be tapered in a direction toward the first surface of the first member.

The intermediate portion of the connecting element may comprise an opening through which cooling fluid is permitted to flow from cooling passages defined on opposing sides of the intermediate portion.

The socket may comprise a stop for engaging an end of the tail-shaped securing portion.

The securing portions of the connecting elements of the second member may be bonded to the first member within the cavities of the first member.

The first member may comprise a slot provided adjacent to and in communication with each of the cavities and may further comprise a brazing wire provided in each slot. Each of the brazing wires may melt during a brazing operation to provide brazing material for bonding a corresponding one of the connecting element securing portions with the first member.

The component may be a turbine blade, a turbine vane, a turbine ring segment a combustor, or a transition duct.

A distance between the first surface of the first member and the first surface of the second member may be between about 0.5 mm and about 2 mm.

In accordance with another embodiment of the invention, a method of forming a component for use in a turbine engine is provided. The method comprises providing a first member and a second member and coupling the first and second members together. Securing portions at ends of connecting elements on the second member are received in corresponding cavities formed in the first member to attach the second member to the first member such that a first surface of the second member is spaced apart from a first surface of the first member. At least one cooling passage is formed between adjacent connecting elements and the first surface of the first member and the first surface of the second member.

The first member may be formed from a first material and the second member may be formed from a second material different from the first material. The first material may have mechanical strength properties which are greater than mechanical strength properties of the second material.

The securing portions of the connecting elements of the second member may be inserted into the cavities of the first member.

The securing portions of the connecting elements of the second member may be bonded to the first member within the cavities of the first member.

Bonding the securing portions of the connecting elements of the second member to the first member may comprise melting brazing wires disposed in slots provided adjacent to and in communication with the cavities in the first member to bond the connecting element securing portions with the first member.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
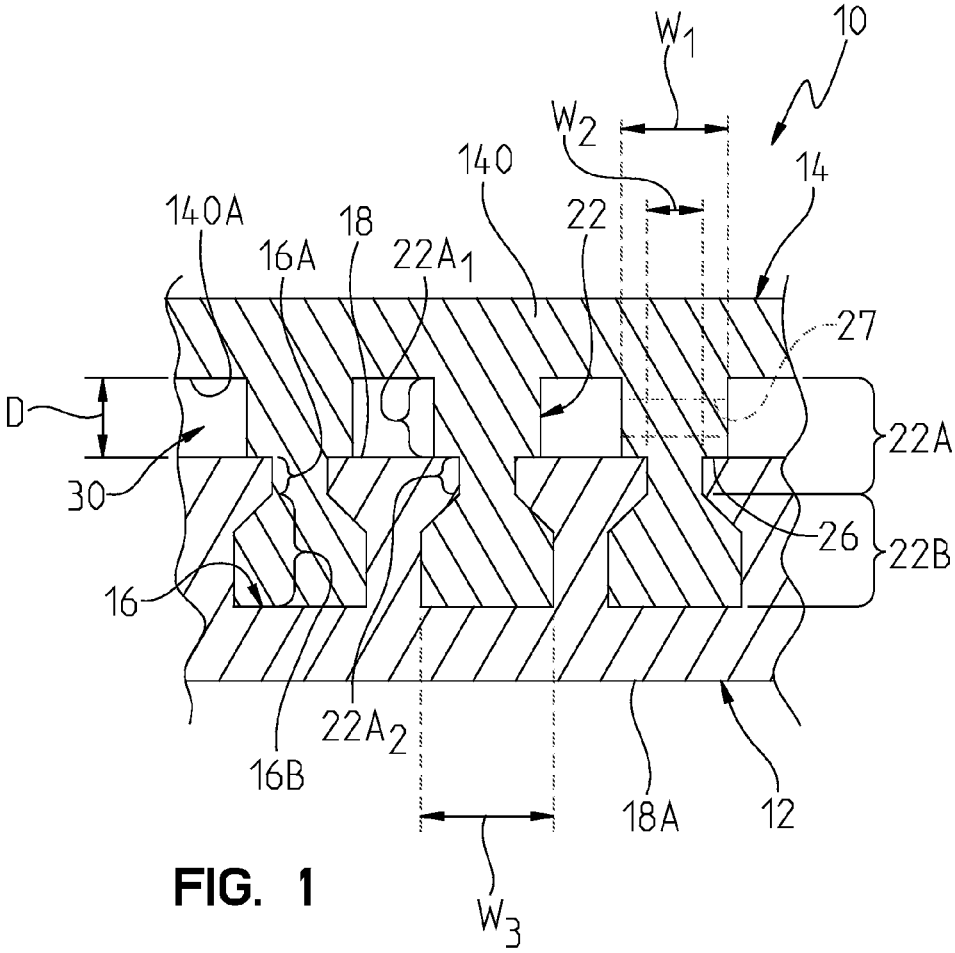
FIG. 1 is a side cross sectional view of a portion of a component for use in a turbine engine according to an embodiment of the invention.

FIG. 1 illustrates in cross section a portion of a component 10 for use in a gas turbine engine. The component 10 may be a turbine blade, a turbine vane, a turbine ring segment, a combustor (annular or can-annular), or a transition duct, for example, and comprises a first member 12 and a second member 14.

The first member 12 is formed, for example, from a nickel-based superalloy or cobalt-based superalloy, such as a nickel-based superalloy CM 247 LC (CM 247 LC is a registered trademark of Cannon-Muskegon Corporation of Muskegon, Mich.) or a nickel-based superalloy sold as "INCONEL alloy" (INCONEL is a registered trademark of Special Metals Corporation of New Hartford, N.Y.). Nickel-based superalloys and cobalt-based superalloys demonstrate very good properties under temperatures of about 1000° C., including, for example, excellent mechanical strength. For example, the nickel-base superalloy CM 247 LC exhibits an ultimate tensile strength (UTS) of approximately 1000 MPa at a temperature of 800° C., falling to approximately 550 MPa at a temperature of 1000° C. A cobalt-base alloy X-45 exhibits a UTS of approximately 400 MPa at a temperature of 800° C. falling to approximately 130 MPa at a temperature of 1000° C.

Figure 2:
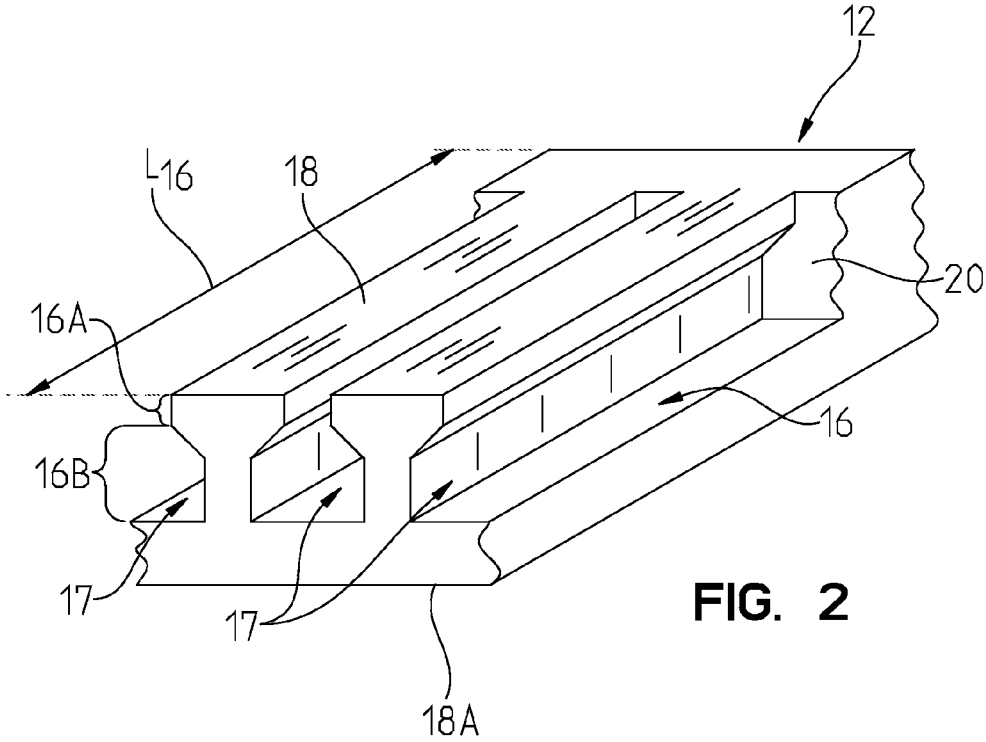
FIG. 2 is a perspective view of a portion of a first member of the component illustrated in FIG. 1.

The first member 12 comprises a plurality of cavities 16 extending inwardly from an outer surface 18, see FIGS. 1 and 2. The cavities 16 may be configured to define a series of elongate rows or columns, as shown in FIG. 2, or be formed in other suitable configurations. As shown in FIGS. 1 and 2, the cavities 16 comprise a first area 16A defining an entrance portion of the cavity 16 and a second area 16B defining a socket of the cavity 16. The second area 16B is tapered toward the outer surface 18 of the first member 12. Each cavity 16 includes a stop 20 formed at an end thereof see FIG. 2.

The second member 14 is formed, for example, from an aluminide, e.g., NiAl or $Ni_3Al$, or a MCrAl-based material, where M may be Fe, Co, Ni, or a combination of two or more of Fe, Co, Ni. Other alloying additions, such as rare earth elements e.g., hafnium, cerium, neodymium, or lanthanum may also be included. For example, hafnium or neodymium may be added in amounts of up to about 2% by weight of the material forming the second member 14, and up to several hundred ppm of lanthanum and/or cerium may be added. It is believed that these materials, i.e., aluminide and a MCrAl-based material, where M may be Fe, Co, Ni, or a combination of two or more of Fe, Co, Ni, have very good high temperature characteristics and properties, including, for example, excellent oxidation resistance and corrosion resistance at temperatures of up to at least 1400° C. The excellent oxidation resistance and corrosion resistance is believed to result due to the formation of a stable coherent alumina film formed on the surface of the second member 14 at high temperatures, as is known in the art. It is understood that the low temperature (e.g. below 1000° C.) mechanical strength of the material forming the first member 12 may be greater than the mechanical strength of the material forming the second member 14. For example, PM2000 (manufactured by Plansee), an oxide dispersion strengthen heat resistant Fe—Cr—Al alloy, exhibits a UTS of approximately 120 MPa and 90 MPa at temperatures of 800° C. and 1000° C., respectively. The material from which the second member 14 is formed may have a coefficient of thermal expansion much lower than that of the material from which the first member 12 is formed. For example, the coefficient of thermal expansion of FeCrAl is about $10\times10^{-6}$ per ° C. at room temperature, while the coefficient of thermal expansion of INCONEL is about $12\times10^{-6}$ per ° C. at room temperature. It is believed to be advantageous to form the first and second members 12, 14 from materials having different coefficients of thermal expansion because the operating temperature the first member 12 is typically exposed to or experiences in a gas turbine engine is between about 800° C. and 1000° C., and the operating external surface temperature the second member 14 is typically exposed to or experiences is about 1150° C. Since the second member 14 is formed from a material having a lower coefficient of thermal expansion than that of the first member 12, the first and second members 12, 14 may expand/contract about the same amount during turbine operation in their respective temperature ranges, which reduces thermal strain and stress on the first and second members 12, 14.

The second member 14 comprises a plate-like portion 140, which may define an outer shell of a vane or blade. The outer shell is adapted to be exposed to high temperature gases during operation of a gas turbine engine, e.g., gases at a temperature of about 1150 degrees C., in which the vane or blade is used. The second member 14 further comprises a plurality of connecting elements 22 extending from an inner surface 140A of the plate-like member 140. The connecting elements 22 have a length substantially equal to a length $L_{16}$ of a corresponding cavity 16, wherein the length $L_{16}$ extends from an entrance 17 of the cavity 16 to the stop 20, as shown in FIG. 2. While the connecting elements 22 have been illustrated as being part of the second member 14 and the cavities 16 as being formed in the first member 12, it is understood that the connecting elements 22 could be part of and extend from the first member 12 and the cavities 16 could be formed in the second member 14 without departing from the spirit and scope of the invention.

In the illustrated embodiment, each of the connecting elements 22 comprises an intermediate portion 22A and a securing portion 22B. The intermediate portion 22A extends from the inner surface 140A of the plate-like member 140 and is integral with a corresponding securing portion 22B. In the embodiment shown, each intermediate portion 22A comprises first and second parts $22A_1$ and $22A_2$, respectively, wherein a step 26 is defined where the first and second parts $22A_1$ and $22A_2$ meet, see FIG. 1. The step 26 is formed due to the first part $22A_1$ of the intermediate portion 22A having a width dimension $W_1$ that is slightly greater than a width dimension $W_2$ of the second part $22A_2$. As shown in FIG. 1, the step 26 engages the outer surface 18 of the first member 12 such that the first part $22A_1$ of the connecting element 22 is prevented from entering the first area 16A of the cavity 16. It is understood that only a selected number of connecting elements 22 may include the connecting element step 26, including an embodiment where none of the connecting elements 22 includes the connecting element step 26.

In the embodiment shown in FIG. 1, each securing portion 22B substantially conforms to the tapered shape of the second area 16B of the corresponding cavity 16, thus giving the securing portion 22B a tapered tail-shape. The first and second members 10 and 12 are coupled together by inserting the second parts 22$A_2$ and the securing portions 22B of the connecting elements 22 into the cavities 16. An end of each second part 22$A_2$ and securing portion 22B may engage the stop 20 of the corresponding cavity 16 to limit movement between the first member 12 and the second member 14. As shown in FIG. 1, since the securing portions 22B have a width $W_3$ greater than a width of the first areas 16A of the cavities 16 (which correspond to the width $W_2$ of the second parts 22$A_2$ of the connecting elements 22), the securing portions 22B are retained in the second areas 16B of the cavities 16 so as to secure the second member 14 to the first member 12.

Cooling passages 30 are defined between the inner surface 140A of the plate-like member 140, the outer surface 18 of the first member 12, and the first parts 22$A_1$ of the connecting elements 22. The cooling passages 30 are preferably configured such that a distance D between the inner surface 140A of the plate-like member 140 and the outer surface 18 of the first member 12 is between about 0.5 mm and about 2 mm, but may be slightly less than 0.5 mm or slightly greater than 2 mm without departing from the spirit and scope of the invention. During operation of the turbine engine, cooling fluid is circulated through the cooling passages 30 such that energy in the form of heat is transferred, such as from the second member 14, to the cooling fluid so as to cool the second member 14, which, as noted above, may define an outer shell of a vane or blade exposed to high temperature gases during operation of a gas turbine engine in which the vane or blade is incorporated. Heat may also be transferred from the first member 12 to the cooing fluid.

Optionally, one or more openings 27 may be formed in the first part 22$A_1$ of at least one connecting element 22, see FIG. 1. The openings 27 may allow cooling fluid to flow therethrough between cooling passages 30 defined between the first and second members 12, 14 on opposing sides of the connecting element 22. Bores (not shown) may be provided in the first member 12 to allow cooling fluid to enter the cooling passages 30 from an inner cavity defined by an inner surface 18A of the first member 12.

The first and second members 12, 14 may be held joined together in any suitable manner, such as by a friction fit between the second parts 22$A_2$ and the securing portions 22B with inner walls defining the cavities 16 in the first member 12. The cavities 16 shown in FIG. 2 are suitably sized such that the second parts 22$A_2$ and the securing portions 22B can be inserted with a minimal amount of force into the cavities 16 and the second member 14 can be moved relative to the first member 12 until the ends of the second parts 22$A_2$ and the securing portions 22B abut the stops 20 of the cavities 16. If desired, the first and second members 12, 14 can be affixed together, such as by brazing, for example, which will be described in detail below. Alternately, the first and second members 12, 14 may be integrally formed by an injection molding process as described in concurrently filed U.S. patent application having docket number 2008P08568US, entitled "INJECTION MOLDED COMPONENT".

The second member 14 may define a thermal shield for the first member 12 from high temperature gases moving through the turbine section of the gas turbine engine in which the component is used. Further, since the first member 12 is maintained at a much lower temperature than the second member 14 during turbine engine operation, the first member 12 may be formed from a material, such as one of the materials set out above, having excellent strength properties at temperatures equal to or less than about 1000 degrees C. and, hence, provide the majority of the mechanical strength required to support the component 10 in the turbine section. Because the first member 12 provides the majority of the strength required to support the component 10 in the turbine section, the second member 14 may be made from a material which has less strength but better oxidation and corrosion resistance when exposed to the high temperature gases in the turbine section of the gas turbine engine.

Additionally, the distance D between the outer surface 18 of the first member 12 and the inner surface 140A of the plate-like member 140 is believed to be less than that of prior art components having integral first and second members. Therefore, cooling efficiency provided to the first and second members 12, 14 is believed to be enhanced, since a reduced amount of cooling fluid can be provided to the cooling passages 30 while providing substantially the same amount of cooling to the first and second members 12, 14 as in prior art components. Specifically, it has been found that a 25% reduction in the amount of cooling fluid can be provided to the cooling passages 30 while maintaining the cooling of the first and second members 12, 14 at or near that of prior art components. The reduced amount of cooling fluid used to cool the first and second members 12, 14, while maintaining cooling to the first and second members 12, 14, increases the cooling efficiency of the component 10.

Figure 3:
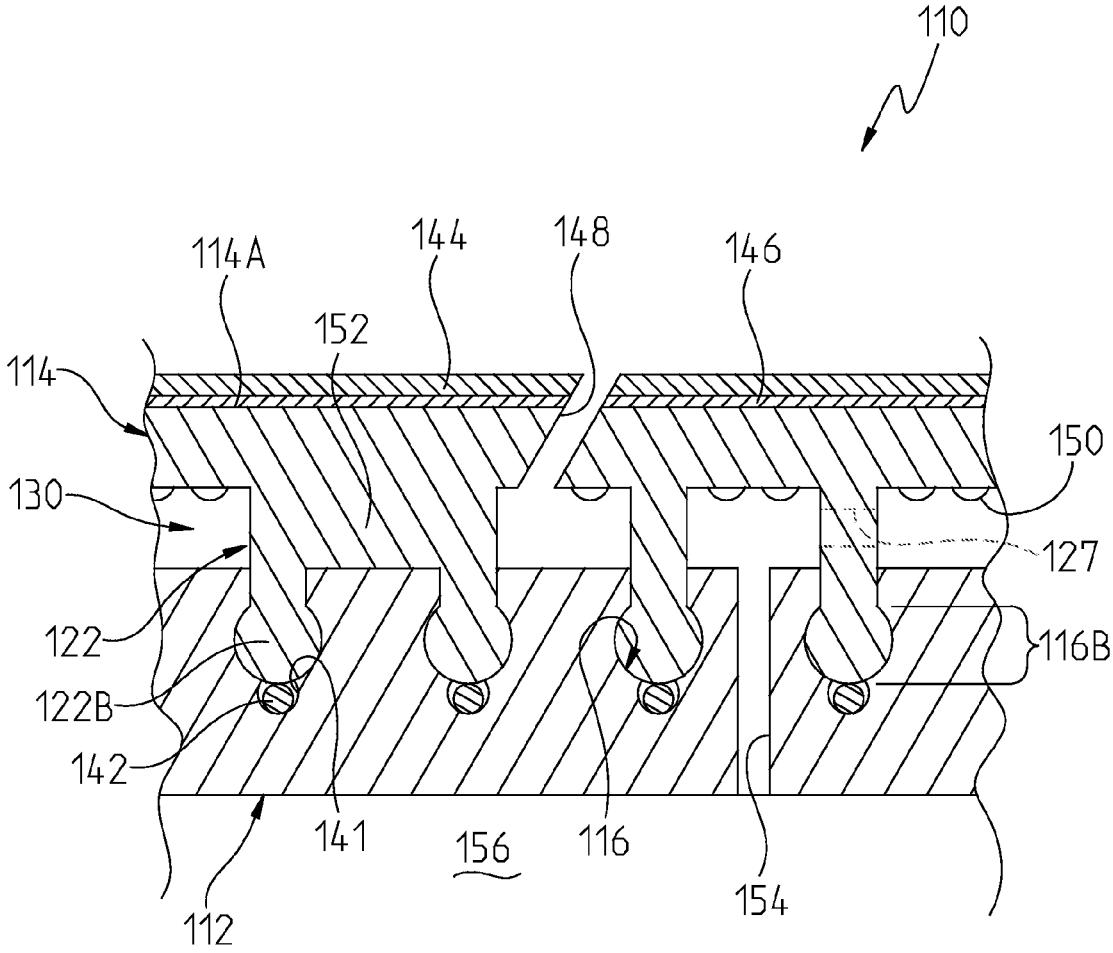
FIG. 3 is a side cross sectional view of a portion of a component for use in a turbine engine according to another embodiment of the invention.

FIG. 3 illustrates a component 110 for use in a gas turbine engine constructed in accordance with a further embodiment of the present invention. In this embodiment, corresponding structure to that described above with reference to FIGS. 1-2 is identified by the same reference numeral increased by 100. Securing portions 122B of connecting elements 122 in this embodiment are dome shaped and correspond to dome-shaped second areas 116B of cavities 116 of the first member 112.

The first member 112 includes elongate slots 141 formed therein adjacent to and in communication with the cavities 116. It is understood that all or only some of the cavities 116 may include an associated slot 141. A braze wire 142 may be disposed in one or more of the slots 141, such that after the securing portions 122B of the second member 114 are disposed in the cavities 116, the braze wires 142 may be melted to provide brazing material to bond the securing portions 122B within the cavities 116 and affix the first and second members 112, 114 together.

A thermal barrier coating (TBC) 144 and/or a bond coat 146, both of which are well known and will not be described in detail herein, may be applied to an outer surface 114A of the second member 114 to provide a thermal barrier for the second member 114. It is noted that the material forming the second member 114 exhibits better compatibility with the protective TBC 144 than the material forming the first member 112, which provides an increased lifespan of the TBC 144 as opposed to providing the TBC 144 on the first member 112.

Bores 148 may be formed through the second member 114 which define pathways for cooling air to exit corresponding cooling passages 130 and pass through and out from the second member 114 so as to provide an outer film cooling layer for the component 110.

Either or both of the first and second members 112, 114 may include protuberances 150, such dimples or trip strips, extending into the cooling passages 130 to enhance cooling by providing additional surface area to be cooled and promoting a more turbulent cooling air flow, which is known to increase cooling.

One or more of the cooling passages 130 formed between the first and second members 112, 114 and the connecting elements 122 may be blocked with a channel blocking structure 152, which may be an integral part of one or both of the first and second members 112, 114 or may be a separately formed piece disposed between the first and second members 112, 114 and the connecting elements 122. The channel blocking structure 152 could be used to prevent cooling air from flowing in a particular area and thus cooling fluid could be used to cool other areas more efficiently.

The first member 112 may comprise one or more cooling air inlets or bores 154 to allow cooling air located in an internal cavity 156 of the first member 112 to flow into the cooling passages 130 and thus provide cooling for the first and second members 112, 114. One or more cooling air inlets 154 may communicate with each cooling passage 130. Further, one or more openings 127 may be formed in one or more of the connecting elements 122 so as to allow cooling fluid to pass from one cooling passage 130 to an adjacent cooling passage 130.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A component for use in a turbine engine comprising:

a first member; and a second member associated with said first member, said second member including a plurality of connecting elements extending therefrom, said connecting elements including securing portions at ends thereof that are received in corresponding cavities formed in said first member to attach said second member to said first member, wherein said connecting elements are constructed to space apart a first surface of said second member from a first surface of said first member such that at least one cooling passage is formed between adjacent connecting elements and said first surface of said second member and said first surface of said first member.

2. The component as set out in claim 1, wherein said first member is formed from a first material and said second member is formed from a second material different from said first material.

3. The component as set out in claim 2, wherein said first material has a coefficient of thermal expansion which is greater than a coefficient of thermal expansion of said second material.

4. The component as set out in claim 3, wherein said first material is one of a nickel-based superalloy and a cobalt-based superalloy and said second material comprises one of an aluminide and a material comprising Cr, Al, and at least one of Fe, Co, and Ni.

5. The component as set out in claim 1, wherein said securing portion of at least one of said connecting elements is tail shaped and at least one of said cavities defines a socket to receive said tail-shaped securing portion.

6. The component as set out in claim 5, wherein said at least one connecting element further comprises a intermediate portion integral with said tail-shaped securing portion, said intermediate portion having first and second parts, said first part having a width dimension greater than a width dimension of said second part such that a step is formed where said first and second parts meet, said step engaging said first surface of said first member when said tail-shaped securing portion is positioned in said socket.

7. The component as set out in claim 6, wherein said tail-shaped securing portion is tapered in a direction toward said first surface of said first member.

8. The component as set out in claim 6, wherein said intermediate portion of said at least one connecting element comprises an opening through which cooling fluid is permitted to flow from cooling passages defined on opposing sides of said intermediate portion.

9. The component as set out in claim 5, wherein said socket comprises a stop for engaging an end of said tail-shaped securing portion.

10. The component as set out in claim 1, wherein said securing portions of said connecting elements of said second member are bonded to said first member within said cavities of said first member.

11. The component as set out in claim 10, wherein said first member further comprises a slot provided adjacent to and in communication with each of said cavities and further comprising a brazing wire provided in each slot, each of said brazing wires melting during a brazing operation to provide brazing material for bonding a corresponding one of said connecting element securing portions with said first member.

12. The component as set out in claim 1, wherein the component is one of a turbine blade, a turbine vane, a turbine ring segment, a combustor, and a transition duct.

13. The component as set out in claim 1, wherein a distance between said first surface of said first member and said first surface of said second member is between about 0.5 mm and about 2 mm.

14. A method of forming a component for use in a turbine engine comprising:

providing a first member and a second member; and coupling the first and second members together, wherein securing portions at ends of connecting elements on the second member are received in corresponding cavities formed in the first member to attach the second member to the first member such that a first surface of the second member is spaced apart from a first surface of the first member, at least one cooling passage being formed between adjacent connecting elements and the first surface of the first member and the first surface of the second member.

15. The method as set out in claim 14, wherein said providing a first member and a second member comprises providing a first member formed from a first material and a second member formed from a second material different from the first material, the first material having mechanical strength properties which are greater than mechanical strength properties of the second material.

16. The method as set out in claim 14, wherein the first and second members are coupled together such that a distance between the first surface of the second member and the first surface of the first member is between about 0.5 mm and about 2 mm.

17. The method as set out in claim 14, wherein said coupling the first and second members together comprises inserting the securing portions of the connecting elements of the second member into the cavities of the first member.

18. The method as set out in claim 17, wherein said coupling the first and second members together further comprises bonding the securing portions of the connecting elements of the second member to the first member within the cavities of the first member.

19. The method as set out in claim 18, wherein said bonding the securing portions of the connecting elements of the second member to the first member comprises melting brazing wires disposed in slots provided adjacent to and in communication with the cavities in the first member to bond the connecting element securing portions with the first member.

20. The method as set out in claim 17, wherein the securing portion of at least one of the connecting elements is tail shaped and at least one of the cavities defines a socket to receive the tail-shaped securing portion.

* * * * *